United States Patent [19]

Meyerhoefer

[11] 3,987,512

[45] Oct. 26, 1976

[54] TILTING FLOOR CLEANER

[75] Inventor: Carl E. Meyerhoefer, Little Neck, N.Y.

[73] Assignee: General Signal Corporation, New York, N.Y.

[22] Filed: June 12, 1975

[21] Appl. No.: 586,193

Related U.S. Application Data

[60] Division of Ser. No. 432,531, Jan. 11, 1974, Pat. No. 3,947,911, which is a continuation-in-part of Ser. No. 323,335, Jan. 12, 1973, abandoned.

[52] U.S. Cl. ..... 15/50 R; 15/246

[51] Int. Cl.[2] ..... A47L 11/16

[58] Field of Search ..... 15/50 R, 98, 49 R, 246, 15/385

[56] References Cited

UNITED STATES PATENTS 2,640,211 6/1953 Petersen ..... 15/50 R 3,010,135 11/1961 Pollnow, Jr. ..... 15/246

*Primary Examiner*—Edward L. Roberts

*Attorney, Agent, or Firm*—Milton E. Kleinman; John F. Ohlandt

[57] ABSTRACT

A rug scrubbing machine for cleaning variable depth sculptured rugs and the like which features an arrangement permitting selective tilting of the frame carrying the scrubbing brushes. Variation in the tilting angle is achieved by pivotally mounting the front wheel, with means for selectively controlling the orientation of the bracket carrying the front wheel. Also provided is "free floating" axial movement of the brushes so as to accommodate varying textures and thicknesses of the rugs to be cleaned, thereby foreclosing any need to adjust the device manually as rugs of different characteristics are encountered except insofar as different tilt angles are called for.

3 Claims, 18 Drawing Figures

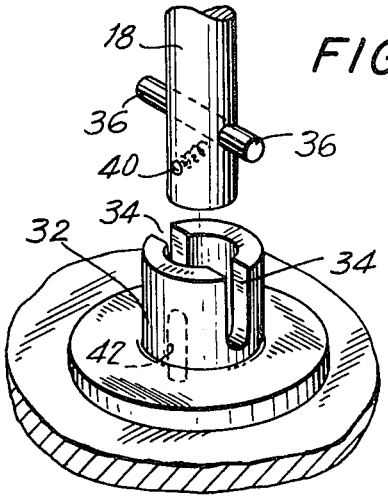
FIG. 5
FIG. 2
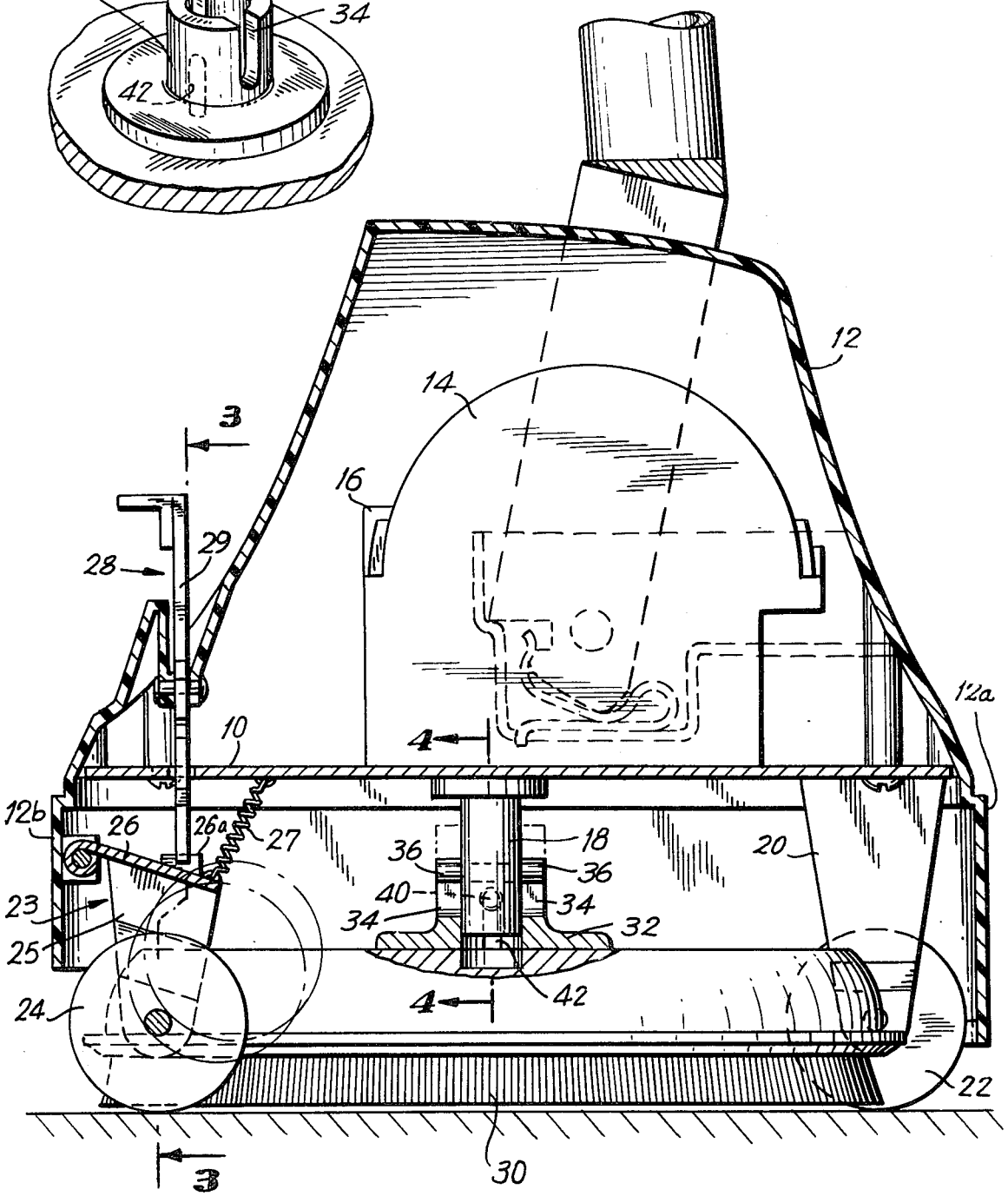

FIG. 10
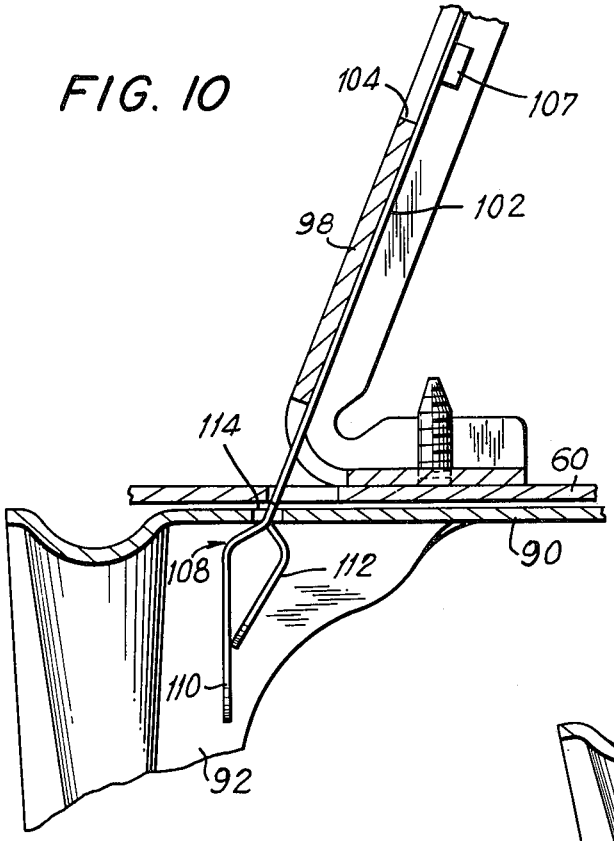
FIG. 11
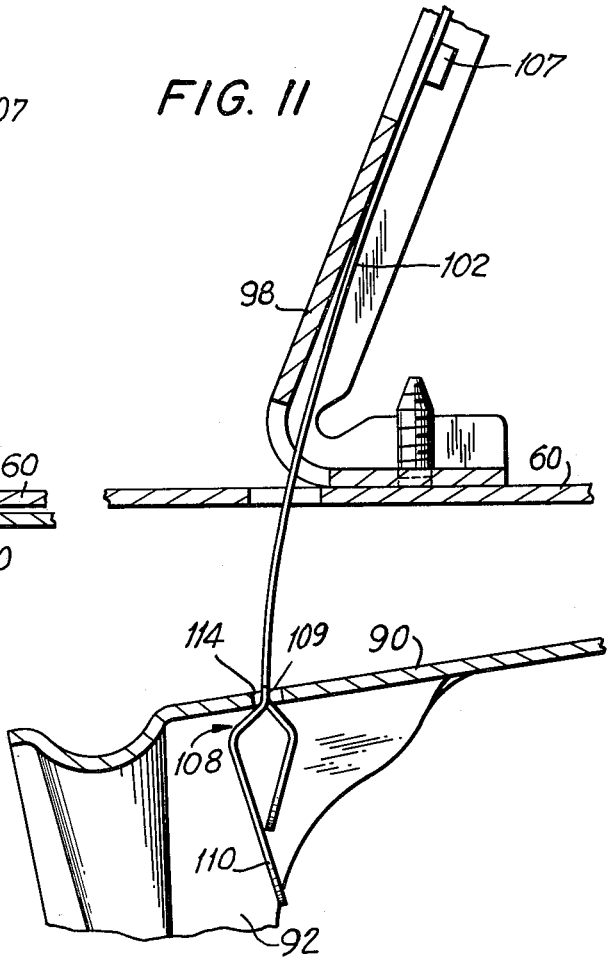
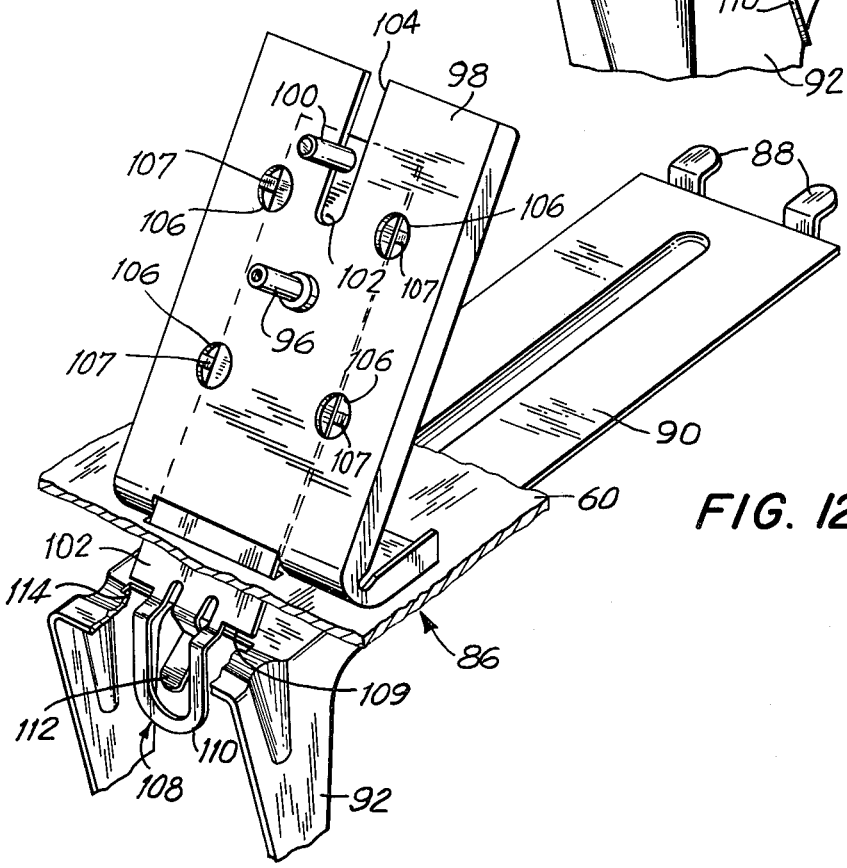
FIG. 12

TILTING FLOOR CLEANER

RELATED APPLICATION

This application is a divisional of application Ser. No. 432,531 filed Jan. 11, 1974, now U.S. Pat. No. 3,947,911, which is a continuation-in-part of application Ser. No. 323,335 filed Jan. 12, 1973, now abandoned. The benefit of such filing date for the parent application with respect to all common subject matter is herewith claimed.

BACKGROUND, OBJECTS AND SUMMARY OF THE INVENTION

This invention pertains to floor cleaning and rug scrubbing machines, and more particularly to an improvement in such machines so that they are adaptable to the task of cleaning rugs whose characteristics are such that it is extremely difficult to reach down into their pile for thorough cleaning thereof.

An example of a rub scrubbing machine known in the prior art is that described in U.S. Pat. No. 2,640,211 to W. L. Petersen. The machine described in the Petersen patent involves the provision of a frame and cradle structure for supporting the brush, whereby the effective contact between the floor and brush surface may be controlled. The operative principle of such machine is the sliding of a frame back and forth on a fixed incline so as to vary the amount of contact of the forward side of the brush with a rug surface.

However, it has become necessary in light of developments in variously sculptured rugs, that is, rugs having wide variations in the depth of depressions formed therein, that a scrubbing machine be adapted to enable thorough cleaning of such rugs including the surfaces defining the depressions.

Accordingly, it is a primary object of the present invention to enable the thorough cleaning of rugs of the aforesaid character by permitting tilting of the brushes at selected angles.

Another object is to enable a difference in the tilt angle to be achieved while avoiding any objectionable tendency of the machine to creep or wander.

Another object is to simplify the means for adjusting the positioning of the brushes such that they can be moved out of contact with a rug surface.

Another object is to make the rug scrubbing machine adjustable to the task of waxing floors by permitting raising of the whole machine from the floor by the use of a brush having longer than normal size bristles. As a result the machine is entirely supported by the brushes.

A further object is to facilitate variation in the amount of contact or area of contact of the one side of the brush or brushes with the rug to be cleaned.

Yet another object of the present invention is to provide a rug scrubbing machine having rotary scrubbing brushes mounted so that their axes are generally upright, but which may be inclined at varying degrees from the vertical so that only one side of the brushes engages the rug.

An ancillary object is to provide the aforesaid tilting as required, but to accomplish this without any tendency toward binding, whereby the movement of the machine might be impeded.

Other and further objects, which specifically relate to the unique subject matter of the present continuation-in-part application, are to adapt the machine to low cost mass production and simple assembly. Moreover, to satisfy the demands for suitable aesthetic appearance and the ease of use requirements for a domestic appliance.

The above objects are fulfilled by a first feature of the present invention which permits the tilting of the frame carrying the brushes. More specifically, tilting is realized by pivotally mounting the front wheel of the machine; such mounting being preferably at the front wall of an integral housing for the machine.

Any tendency for the brushes to bind with the rug or other surface being cleaned is avoided because of the "free floating" provided for the brushes, that is to say, the brushes have a degree of freedom in the vertical direction because of the special construction of the brushes and cooperating parts. In particular, the brushes have hubs in which notches are formed. These notches are engageable with pins radially extending from spindles which operate to drive the brushes. Also provided on the spindles are ball detents which cooperate with suitable grooves in the brush hubs to hold the brushes on the spindles.

Other features relate specifically to the unique or non-common subject matter of the present continuation-in-part application. Such features were developed in consequence of the objects previously recited of adapting the general purposes of the machine to the particular requirements of household application. One of these features resides in the provision of a cam dial for accomplishing the objective of easy movability of the front wheel or roller so as to effect tilting of the machine.

The cam dial is mounted at the front of the machine housing and includes a plurality of stations, involving a plurality of detent positions, which are provided to accomplish the required height adjustment with a substantially uniform favorable ratio, (approximately a 12 to 1 ratio). Such a high ratio is deemed necessary because the combined weight of the polisher and the shampoo liquid is so great that a woman would have difficulty in adjusting the machine without this mechanical advantage.

Another novel feature, in accordance with the aforesaid adaptation of the basic cleaning machine to household use, is the provision of a spring-blade link which transmits the cam rise motion directly to a front wheel support, without lost motion. This spring-blade link is so constructed that the parts can be coupled by simply snapping them together. More specifically, the spring temper of this link is utilized to allow for relative displacement of the parts during the up and down travel of the front wheel support and, at the same time, to provide a convenient means for "snap lock" assembly. The latter provides a coupling which engages the parts so that both "pushing" and "pulling" forces are transmitted.

It will be apparent as the detailed description proceeds that the embodiment of the mechanism for providing tilting of the floor cleaner of the present continuation-in-part application differs from the earlier version of the parent application in that no follower spring is needed with the mechanism. Instead, the entire mechanism, which includes the aforesaid cam dial and link, and also the wheel support, are all carried by a base plate. As a result, there is no dependency for structural support on the cover of the machine. Such dependency is avoided with the present design and construction because it is desired to use plastic for the machine cover which would not be suitable for withstanding the stress encountered.

Yet another feature, in accordance with the present continuation-in-part application, resides in the provision of a splash guard adapted to prevent spraying, due to some centrifugal force primarily, of suds or shampoo during scrubbing of bare floors or during shampooing of carpets. Without such a guard, the suds and the like would be sprayed on the operators feet, which is obviously most undesirable, and also on any close-by objects. The uniqueness of the present splash guard is that it is extremely easily detachable, without the use of tools, in order that it may be cleaned or rinsed after use. In its specific construction these are provided two tabs which extend from the front wall of the guard structure, such tabs being lined up and hooked through to slots provided in the front skirt of the machine cover. It is arranged that the rear end of the guard is pushed upwardly such that it automatically engages two opposing shaft projections of the rear rollers. The splash guard is retained in place by means of a snap lock. Moreover, the splash guard is designed to float on the surface of carpets, but is automatically kept out of contact with bare floors when the machine is operated in any mode other than shampooing. For example, in the scrubbing mode, the front bottom of the guard is close to the floor, but still about 1/16 inch above the floor. Such design avoids any possibility of scratching or otherwise marring a surface which has been highly buffed.

The above and other related objects, features and advantages are achieved in accordance with a preferred embodiment of the invention illustrated in the accompanying drawing.

BRIEF DESCRIPTION OF THE DRAWINGS

FIG. 2 is a side elevational view, partly in section, illustrating the embodiment of FIG. 1.

FIG. 5 is an exploded view of the above arrangement of FIG. 4.

FIGS. 6–14 are views of a second preferred embodiment of a rug scrubbing machine in accordance with the invention in which:

FIG. 6 is a side elevational view partly in section of the rug scrubbing machine.

FIG. 7 is a front elevational view, with parts broken away, of the rug scrubbing machine.

FIG. 8 is a plan view of the splash guard incorporated in the rug scrubbing machine, particular parts of the splash guard being shown in section.

FIG. 9 is a sectional view on the line 9—9 of FIG. 1, illustrating the cam dial.

FIG. 10 is a sectional view of the linkage mechanism for raising and lowering the front wheels, the mechanism being shown at the highest position.

FIG. 11 is a sectional view of the same linkage mechanism as in FIG. 8, but showing the front wheel bracket in a lower position.

FIG. 12 is a perspective view of the linkage mechanism previously shown, but showing other details thereof.

DESCRIPTION OF PREFERRED EMBODIMENTS

First Preferred Embodiment

The first preferred embodiment of the present invention is that initially disclosed in parent application Ser. No. 323,335 filed Jan. 12, 1973.

Figure 1:
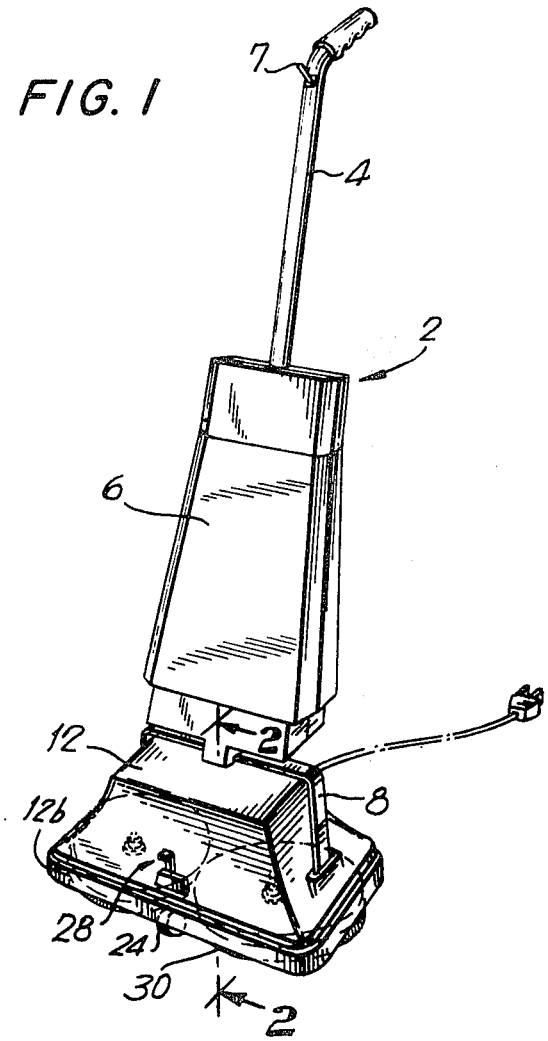
FIG. 1 is a perspective view of a first preferred embodiment of a rug scrubbing machine in accordance with the present invention.
Figure 3:
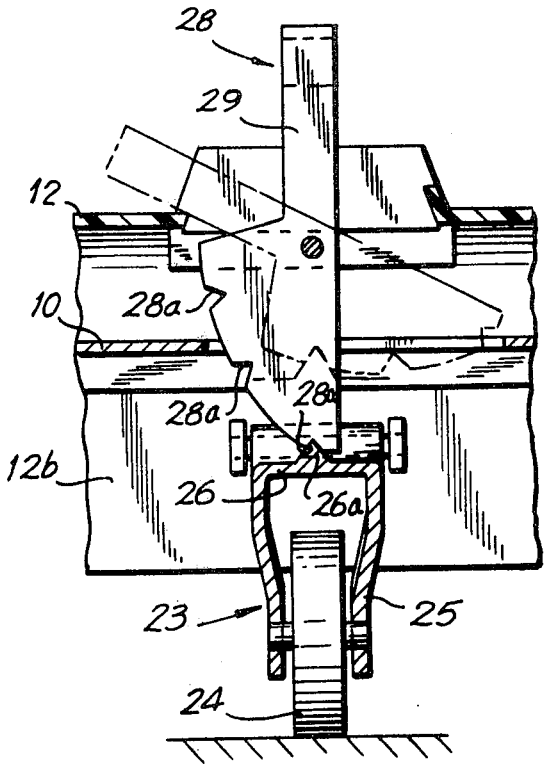
FIG. 3 is a sectional view, taken on the line 3—3 of FIG. 2, of the tilting mechanism of the first preferred embodiment.
Figure 4:
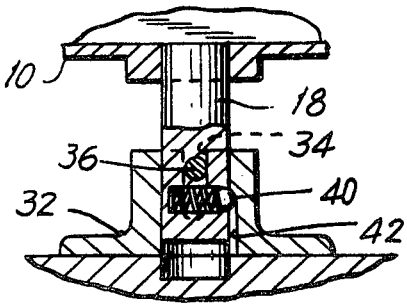
FIG. 4 is a sectional view, taken on the line 4—4 of FIG. 2, illustrating the arrangement for providing axial movement in the driving of the brushes in accordance with the first embodiment.

Referring now to the figures of the drawing and for the moment to FIG. 1, there is shown a rug scrubbing machine generally indicated by the numeral 2 and including a handle 4 which supports a detergent tank 6. Mounted on the handle 4 is a control lever 7 for controlling the flow of the detergent from the tank 6 as required. The handle 4 terminates in a yoke 8 which extends down into the lower portion of the machine and is fastened to bosses 9 therein.

The lower portion of the machine comprises a frame 10 surmounted by a housing 12, the latter including depending skirt portions 12A and 12B. Within the housing 12 and mounted on the frame 10 is a motor 14 and a pair of gear boxes 16 for application of driving power at a suitable gearing reduction. A pair of spindles 18 extend from the respective gear boxes to the underside of the frame 10. The spindles are effectively sealed from the upper portions of the housing by suitable washers so that the detergent foam to be generated cannot reach the upper housing. Operatively engaged with the spindles to be driven thereby is a pair of brushes 30 especially useful for the scrubbing of variable depth rugs.

At the rear of the machine a pair of brackets 20 are affixed to the frame 10 for the purpose of carrying the rear wheels 22.

The variable tilting angle feature of the present invention can be appreciated by reference to the forward part of the machine where it will be seen that the front wheel bracket 23 is pivotally mounted on the front skirt portion 12B of the housing 12. The wheel 24 is mounted for rotation on its axis in the lower part of the bracket comprising a U-shaped member 25 depending from an arm or plate 26.

The lower-most positioning of the wheel 24, as seen in FIG. 2, represents a condition whereby the brushes 30 are elevated above the floor and therefore are ineffectual for the purpose of scrubbing. Rather, in this position the machine can be transported without the brushes constituting an impediment to movement, that is to say, the machine moves readily on its wheels 22 and 24 without any interference from the brushes 3C. In the next position in the counterclockwise direction for the wheel 24 it will be noted that the brushes will then make slight contact over a significant arc with the rug or other article to be cleaned. This is because such counterclockwise rotation results in lowering of the front end of the machine. Further rotation of the bracket 23 in a counterclockwise direction brings about relative movement of the wheel 24 with respect to the frame or housing with the result that the frame will be tilted at a greater angle than previously.

Therefore, the brushes, fixed to the frame, will be at a greater angle of inclination with respect to the rug.

Control over the pivotal movement of the bracket 23 is afforded by a cam 28 which is provided with an integral lever 29 for the purpose of bringing about rotational movement of the cam 28. The cam 28 is mounted in bearing blocks for the desired rotational movement and extends through an opening to the underside of frame 10. The cam is so shaped and is so mounted that when rotated it projects to varying degrees below the frame 10 so as to contact the plate 26 and rotate the bracket 23 to different positions. This plate is provided with a protuberance 26A which is engageable by the three notches 28A in cam 28 corresponding to the three positions that may be selected for the cam and hence for the bracket 23. The three positions are attainable against the bias produced by spring means 27, as well as against the partial weight of the machine.

The free-floating feature of the present invention is implemented or realized by virtue of the fact that each of brushes 30 has a hub 32 which is provided with an axially extending pair of opposed slots 34 formed in the wall of the hollow shaft. These slots are engageable with pins 36 integrally formed in each of the spindles 18 and radially extending therefrom. As a consequence of such engagement, power supplied to the spindles 18 is transmitted to the brushes 30. Due to the nature of the slots, power is transmitted even though the brushes may be in axial motion within limits established by the extent of the slots.

Accordingly, there is automatic adjustment of the brushes to rugs of different characteristics because of this free floating capability of the brushes for movement relative to the frame. As a result, there is no tendency for binding of the brush with a rug so as to produce an impediment to free movement of the machine.

Once the brushes 30 have been mounted on the spindles 18, they are retained thereon by virtue of the spring-biased ball detents 40 provided on the spindles. These ball detents are spaced about 90° from pins 36 and are received in suitably located axially extending grooves 42 formed in the inner surfaces of the hubs 32.

SECOND PREFERRED EMBODIMENT

The second preferred embodiment of the present invention is an embodiment developed subsequent to the first embodiment, thereby constituting the noncommon subject matter of the present continuation-in-part application. Such subject matter is illustrated in FIGS. 6–14.

Referring now to FIGS. 16–14, the second preferred embodiment takes the form of a rug scrubbing machine generally designated by the numeral 50. This machine includes components such as a handle, detergent tank and the like, but such components have not been specifically illustrated in this embodiment for the sake of simplicity.

Figure 8:
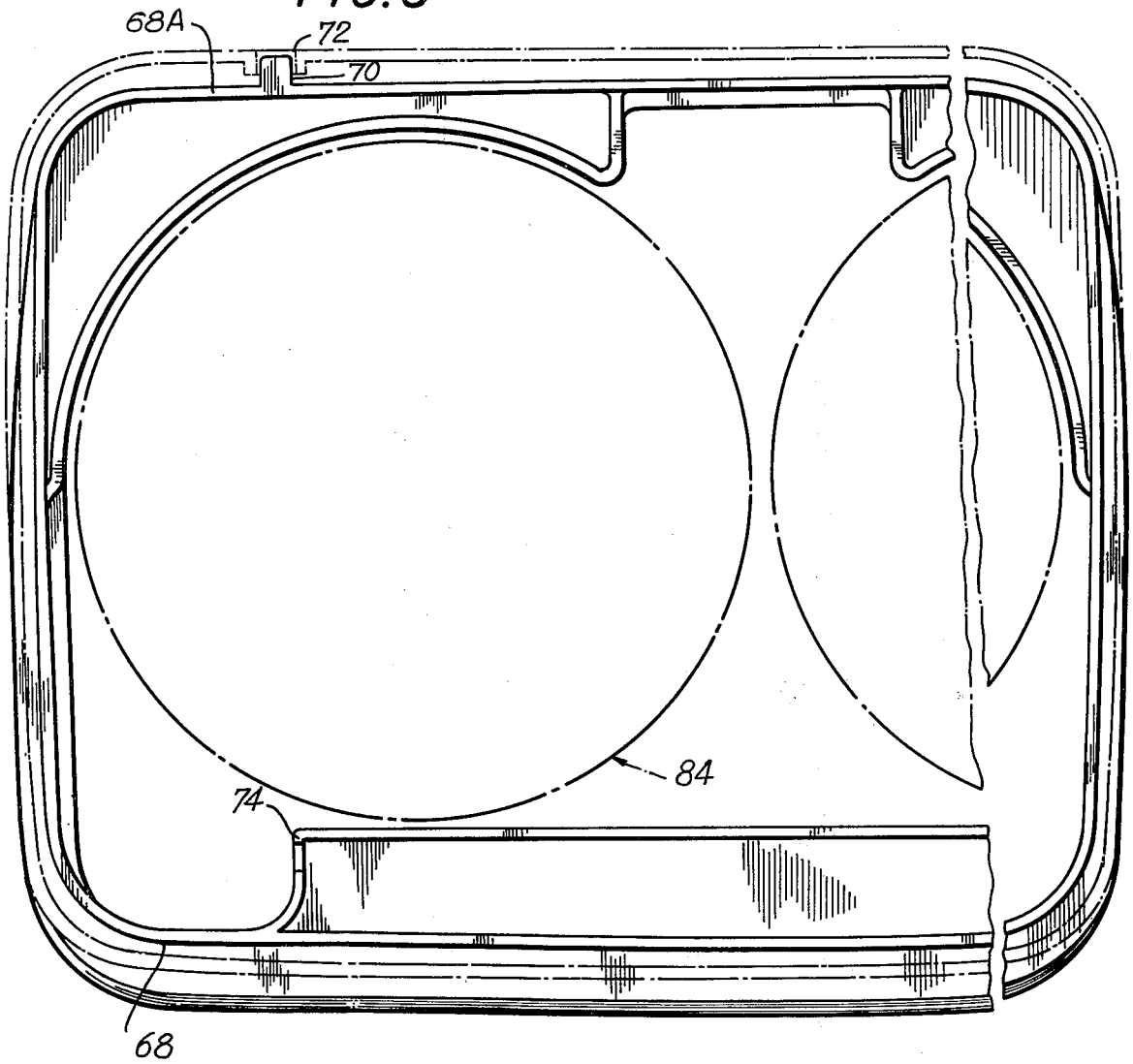

The lower portion of the machine 50 includes a frame or base plate 60 which is surrounded by a plastic cover or housing 62. The base plate 60 is constituted of heavy sheet metal, but the housing or cover 62 is composed of a plastic material which has been suitably molded into the contour illustrated. A bumper 64 is included for protective purposes, such bumper entirely surrounding a skirt 66 at the lower end of the cover. A splash guard 68 is affixed to the cover in order to prevent undesirable splashing of the foam or other cleaning fluid from the interior of the machine. This guard is very easily detached, without the need for tools, in order that it may be thoroughly rinsed after use. To this end, a pair of tabs 70 (as best seen in FIG. 8) extend from the front wall 68A of the guard. The tabs are hooked through slots 72 provided in the front wall of the skirt 66. Attachment of the guard is completed at the rear end of the machine by pushing up on the rear end of the guard until the member 74 snaps and locks over an extended portion of the shafts 76 for the rear rollers or wheels 78.

Figure 6:
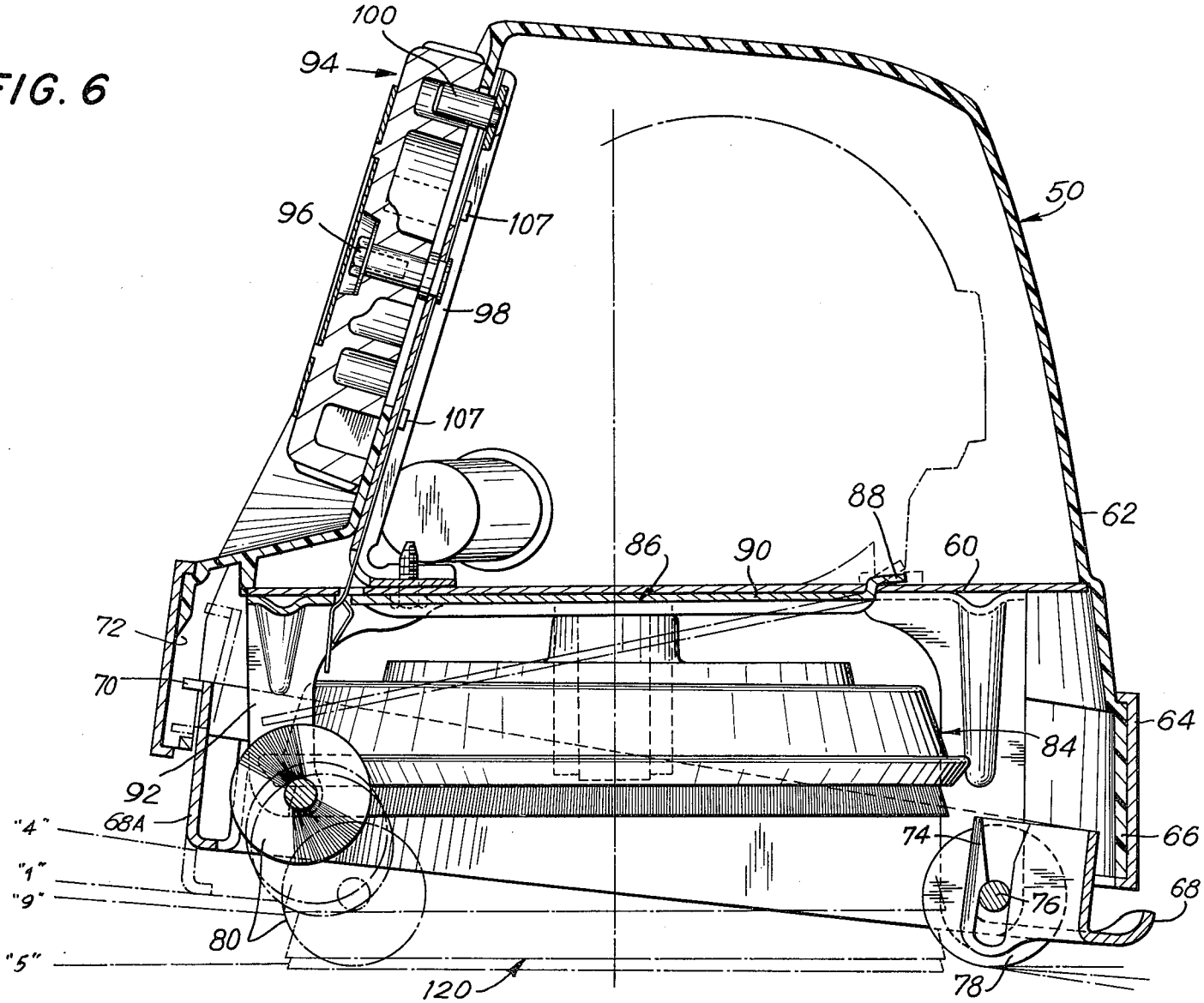
Figure 7:
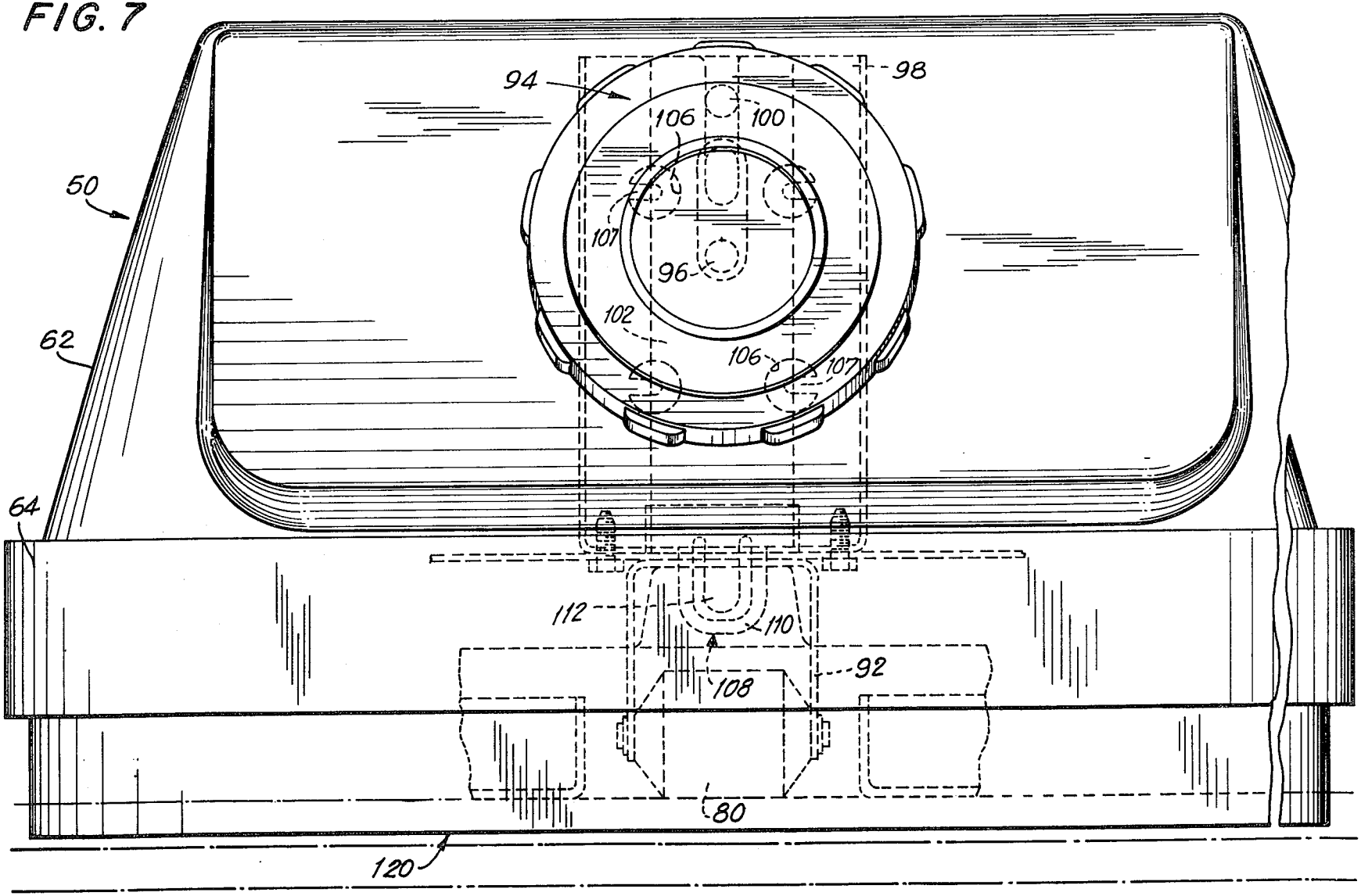
Figure 14A:
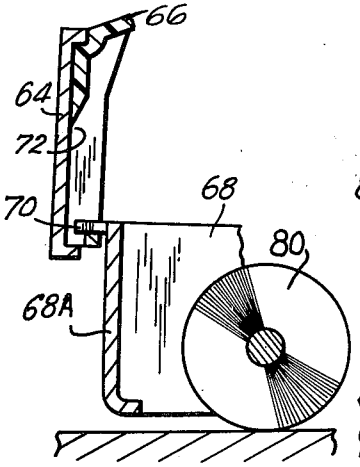
FIGS. 14A, B, C and D are fragmentary views illustrating the relationship of the splash guard with the front and rear of the machine at different cam dial settings.

As has been noted previously, and as may be especially appreciated by reference to FIG. 6 and to FIGS. 14A–14D, the splash guard 68 has been specially designed to float on the surface of carpets and the like, that is to say, to have freedom of movement both at the front and the rear of the machine so as to move upwardly as circumstances dictate, for example, when different kinds of carpet textures are encountered. However, the splash guard is automatically kept out of contact with bare floors when the machine is operated in any mode other than shampooing. Referring specifically to FIG. 14A, there will be seen a fragmentary view of the front part of the machine in which the relationship among the front wheel or roller, the splash guard 68 and the skirt 66 are illustrated. This relationship occurs when "position 5" has been selected for the machine, such mode or position being selected when it is desired to scrub bare floors. Accordingly, in this mode of operation the bottom of the guard 68 is close to the floor, there being a slight clearance which is generally adjusted to be about 1/16 of an inch. Thus there is avoided any possibility of scratching or otherwise marring the surface of a floor which has already been highly buffed, while the clearance provided is insufficient to allow any appreciable splashing to escape beyond the outer contour of bumber 64. It will of course be appreciated that the position shown for the splash guard 68 in FIG. 14A is the lowest position that can be assumed by the splash guard even though the front wheel 80 can be moved to still lower positions as will be seen by reference to FIG. 6.

Figure 14B:
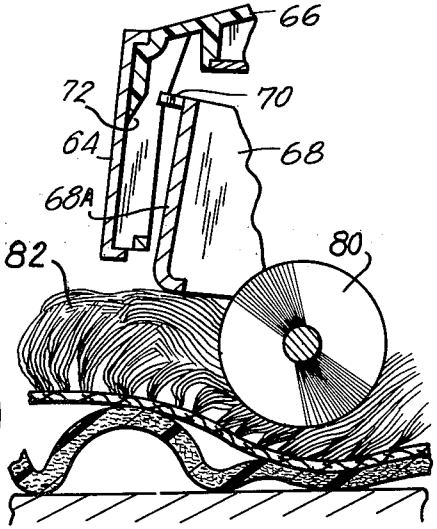
Figure 14C:
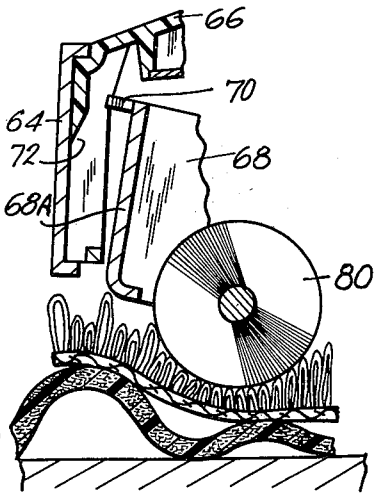

FIGS. 14B and 14C depict other possible positions that can be assumed by the splash guard 68. In particular, FIG. 14B corresponds with the selection of "position 4" for the front wheels and in this position the splash guard 68 floats over the pile 82 that is encountered in shampooing of a shag rug or the like. In FIG. 14C there is shown "position 1" for the front wheels 80, which is a position selected for shampooing sculptured carpets. In this position the greatest degree of tilt for the machine is desired and hence the wheels have been moved to their furthest upward position. Here again, as was the case in "position 4" depicted in FIG. 14B, the splash guard is able to float inasmuch as the tabs 70 will be free to move in their slots 72.

Figure 14D:
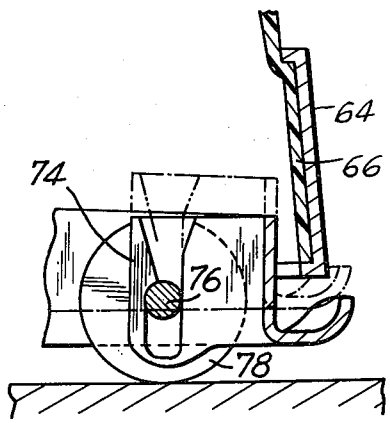

FIG. 14D depicts the rear end of the machine and indicates that the rear end of the splash guard is likewise free to move and will do so when positions 1 and 4 have been selected for the front wheels such that the rear of the splash guard will float or move upwardly in accordance with the texture of carpet encountered. On the other hand, when "position 5" is selected, which is the position corresponding to the scrubbing of bare floors, the rear end of the splash guard will remain in its lowest position. It will be appreciated that for the rear end of the splash guard the amount of movement is limited to about 9/32 of an inch whereas the front end of the splash guard is free to move approximately 1 inch.

The second preferred embodiment being described achieves a basic object which was also achieved by the first preferred embodiment; that is to say, both embodiments enable a difference in tilt angle for the scrubbing brush or brushes to be realized while avoiding any objectionable tendency of the machine to creep or wander. More specifically tilting is realized by pivotally mounting the front wheel of the machine. However, in accordance with the second embodiment the pivotal mounting of the front wheel is accomplished by having the pivot point near the rear of the machine, whereas the mounting for the first embodiment was at the front wall of the integral housing for the machine. Moreover, as will be made clear in the description which follows, the entire structure or mechanism for enabling tilting of the scrubbing brushes, whereby different degrees of contact of the brushes with the surface to be cleaned can be selected, is carried by the strong base plate 60 so that the cover 62 of light plastic may be utilized.

Referring now particularly to FIGS. 6, 7 and 9–11 there will be seen the mechanism for bringing about selective tilting of the brushes 84. It should perhaps be first explained that for the sake of simplifying the drawings, the selection of a variety of wheel positions 80 has been indicated in FIG. 6 by means of solid and dotted lines. It will be understood of course that relative motion is here involved and, accordingly, four different lines designated 1, 4, 5 and 9 have been drawn to indicate the relative position of the surface being cleaned. Also several positions of the brushes 84 have also been indicated in either solid or dotted lines so that the contact of the brushes with the surface being cleaned can be understood and, likewise, the floating of the brushes can be appreciated.

The front roller or wheel 80 is mounted for rotational movement in a bracket 86. The bracket 86 is provided with a pair of pivot tabs 88 at the rear end of a plate-like portion 90 of the bracket, the wheel being supported or carried by depending flanges 92 forming part of the bracket. The pivot tabs 88 extend through suitable openings in the base plate 60, as seen in FIG. 6. Thus, counterclockwise movement of the bracket 86 around the pivot point so established produces the desired relative downward movement of the front wheel or roller 80. The lowermost position for the bracket 86 is indicated by the dotted line showing for the bracket 86. Also, the two extreme positions for the bracket 86 can be seen by reference to the detailed views of FIGS. 10 and 11.

Control over movement of the front wheel bracket is effectuated by means of a cam dial 94 located at the upper front surface of the cover 62. The cam dial 94 is mounted for rotation about a shaft 96, the shaft extending through an opening in the cover and being secured to a bracket 98, which in turn is secured by a bolt or the like to base plate 60. An integral cam follower in the form of a rod 100 is formed at the upper end of a slide link 102 which is movable upwardly and downwardly with respect to such bracket. A slot 104 formed in the bracket 98 allows the rod 100 to follow the movement of cam dial 94. A plurality of spaced guide means 106, comprising bent back tabs 107, define a track and insure proper movement of the slide link 102.

There will be seen at the bottom of the slide link 102 an arrangement 108 which permits "snap-lock" assembly of the slide link with the front wheel bracket 86. As may best be seen in FIG. 12, this arrangement includes a downwardly depending U-shaped member 110 and a tongue-like element 112 which is first bent rearwardly and is then bent downwardly towards the front of the machine. By reason of this particular configuration the parts 110 and 112 can be squeezed together so that they will pass through the opening 114 in the plate 90 of the bracket 86. Because of the resilient nature of the materials used, the parts 110 and 112 will return to their initial configuration as they appear in FIG. 10 for example. Accordingly, the slide link is thereby securely coupled to the wheel bracket.

It should further be noted that the slide link 102 is able to transmit "pushing" forces as well as "pulling" forces because of the particular construction of the means 108. Thus, because of the direct engagement of shoulders 109 of slide link 102 at the opening 114 with the wheel bracket, any downward movement of the slide link is transmitted so as to force the wheel bracket downwardly as will be appreciated from FIG. 11 particularly. As has been indicated previously, it is precisely because of the spring temper of the slide link 102 that relative displacement of the several parts is allowed during the "up-down" travel of the bracket 86.

Figure 9:
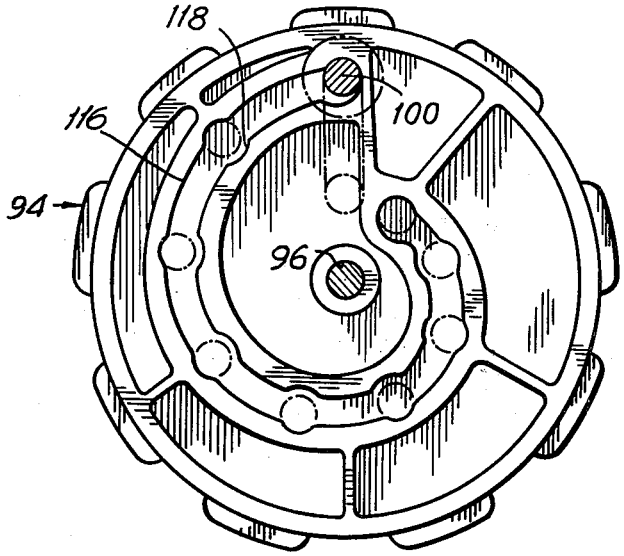

Referring now to FIG. 9, the cam dial 94 is illustrated as having nine positions or stops at 40° from each other around the circumference of the dial. At the interior of the dial there is provided a spiral groove or track 116. This groove includes a series of spaced detent notches 118 corresponding to the nine positions that are selectable by the cam dial for the front wheel 80.

It will be understood that the follower 100 will be compelled to travel in the spiral groove 116 and that it will be retained in each of the detent notches 118 as the different positions are selected by rotation of the cam dial. The total rise of the cam in accordance with a specific embodiment is approximately 0.812 inches, with each dial setting or step accounting for approximately 0.101 inches. Since the circumference of the cam dial is approximately 10 inches, this means that there is a uniform mechanical advantage for each step or setting of the dial which is approximately 12, that is to say there is a 12 to 1 ratio available.

It is to be noted that the cam follower track 116 is designed to move and detent the follower 100 in both the "down" and "up" mode. This is for the purpose of moving the front roller or wheel even if the machine is upside down, as it may be for instance during changing of brushes.

Although only four positions were indicated for the front wheel 80 in FIG. 6, it will be understood that the cam dial 94 has been so designed that a total of nine wheel positions are available. Cam dial setting 1, as noted before, corresponds with the furthest upward movement of the wheel 80, this setting being selected when it is desired to shampoo sculptured carpets and the like. Intermediate settings 2, 3 and 4 are utilized for various textures of pile rugs or shag rugs, whereas dial setting 5 is used when scrubbing floors, in which case brushes 84 are in contact with the floor over a slight arc, as may be appreciated by referring to FIG. 6. Dial settings 6–8 are selected under different circumstances for applying paste wax or polishing or buffing floors and the like, in which case different brushes 120, which are especially adapted for polishing are utilized. Dial settting 9 is the "park" or "store" setting.

Figure 13A:
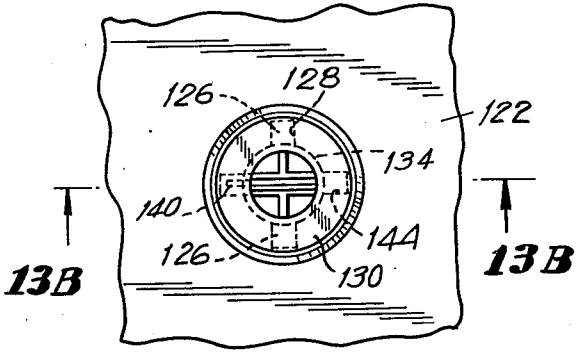
FIGS. 13A and 13B are detailed views of the mechanism for driving the scrubbing or polishing brush.
Figure 13B:
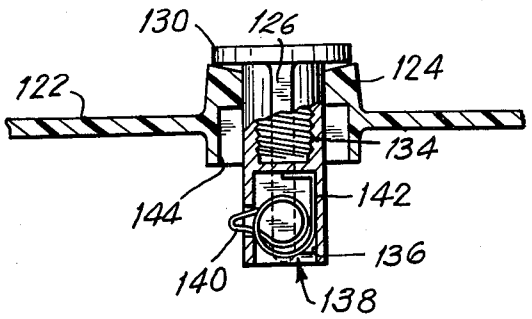

Referring now to FIGS. 13A and 13B several views are provided of a subordinate feature of the invention which lies in the details of the brush drive arrangement in accordance with the second embodiment. Since it has been found desirable to use a completely plastic brush, including the hub portion, it turns out to be advantageous to redesign the drive mechanism. Accordingly, when such a plastic brush is utilized, as for example brush 122 shown in FIGS. 13A and 13B, the present mechanism imposes much less wear on the plastic hub 124 thereof than would normally be the case. This is for the reason that the drive bars 126 that engage with suitable slots 128 in the hub are constructed to have extended, rather than restricted, contact with such slots, as can best be seen by the dotted line showing in FIG. 13B.

It will also be appreciated from FIG. 13B that a bushing 130 is provided to surround a conventional spindle. A spindle extension 134 is threaded onto the bushing 130, the extension including a cavity or chamber 136. The cavity 136 houses a spring retainer or latch means 138 comprising a latch portion 140, which projects through an opening in a sidewall of the cavity-defining portion of the extension 134, and a leg portion 142 which abuts the opposite sidewall and the upper wall at the interior of the cavity. It will be seen, as indicated on FIG. 13B, that ¾ inch "float" is permitted for the brush 122 once it has been placed into position in peripheral abutment with the spindle extension 134. This is because the latch portion 140 of the spring retainer is adapted to project within a groove 144 provided at the interior of the hub 124.

The above described arrangement featuring the spring retainer satisfies the objective of having a superior arrangement to a ball detent or the like, while providing something that is not critical insofar as being restricted to a very limited movement. In other words, a ball detent or the like cannot project out very far, and it is much preferred that the retaining means, as in this case, be able to project fairly far outwardly but to have the capability of retracting readily. This is in order to facilitate assembly and removal of the brushes while assuring positive retention of same once they have been put in place. It should also be noted that equal angles are afforded by the V-shaped latch portion 140. This means that either coming or going, that is to say, in moving the brush upwardly into position on the spindle extension, or removing it therefrom, the relatively large diameter coil spring 138 provides a very soft reaction. This is desirable to avoid the possibility of grooving or otherwise distorting the relatively soft plastic material of the brush hub. The spring retainer or latching means 138 is assembled by first feeding the latch portion 140 into the cavity 136 and then by pushing and squeezing the leg portion 142 to force it into the cavity.

While there have been shown and described what are considered at present to be the preferred embodiments of the present invention, it will be appreciated by those skilled in the art that modification of such embodiments may be made. It is therefore desired that the invention not be limited to these embodiments, and it is intended to cover in the appended claims all such modifications as fall within the true spirit and scope of the invention.

What is claimed is:

1. In a rug scrubbing machine, the combination of:

a frame with at least one substantially flat, circular scrubbing brush rotatably mounted on the frame and positioned below said frame;

a driving motor on said frame to drive the brush;

at least one front wheel for supporting the machine;

a housing for said machine, said housing including a skirt portion;

a splash guard extending below said housing, and means for engaging said splash guard with the skirt portion so as to allow for vertical movement of the splash guard as different rug configurations are encountered, said means including a slot means in said skirt portion at the front of the machine, a pair of tabs on said splash guard engageable with said slot means, and further means providing for snap-locking of said splash guard at the rear of said machine, said further means also providing for pivotal movement of the splash guard.

2. The combination as defined in claim 1, in which said further means providing for snap-locking of said splash guard also provides for vertical movement of the splash guard at the rear of said machine.

3. The combination as defined in claim 2, further including means at the front and rear of the splash guard for providing slight clearance between the lower surfaces of the splash guard and the surface being cleaned.

* * * * *